United States Patent [19]

Norton

[11] 3,983,841

[45] Oct. 5, 1976

[54] TONER RECLAIM CONVEYOR

[75] Inventor: James R. Norton, Walworth, N.Y.

[73] Assignee: Xerox Corporation, Stamford, Conn.

[22] Filed: Mar. 21, 1975

[21] Appl. No.: 560,838

[52] U.S. Cl. ..... 118/637; 118/312; 355/15

[51] Int. Cl.[2] ..... G03G 15/09

[58] Field of Search ..... 355/15; 15/1.5; 118/637, 312

[56] References Cited

UNITED STATES PATENTS

| | | | |
|---|---|---|---|
| 3,641,979 | 2/1972 | Gerbasi et al. | 118/637 |
| 3,678,896 | 7/1972 | Hewitt | 118/637 |
| 3,700,328 | 10/1972 | Davidge et al. | 118/637 |
| 3,724,020 | 4/1973 | Till | 355/15 |
| 3,752,576 | 8/1973 | Gerbasi | 355/15 |
| 3,781,107 | 12/1973 | Ruhland | 118/637 |

*Primary Examiner*—Mervin Stein
*Assistant Examiner*—Douglas Salser

[57] ABSTRACT

An electrostatographic processor having a rotatably driven drum for advancing an imaging surface through successive processing stations, a development system charged with a ferromagnetic developer for developing latent electrostatic images carried by the imaging surface, and a cleaning system including a sump for collecting residual toner removed from the imaging surface is equipped with a toner reclaim system comprising a plurality of permanent magnets which are mounted at spaced apart intervals on one end of the drum to magnetically convey developer from the development system to the cleaning system sump via one non-magnetic conduit and from the cleaning system sump back into the development system via another non-magnetic conduit. The developer blends with the residual toner while passing through the sump of the cleaning system, with the result that its toner concentration tends to increase, thereby causing residual toner to be mechanically and triboelectrically returned to the development system.

15 Claims, 7 Drawing Figures

TONER RECLAIM CONVEYOR

BACKGROUND OF THE INVENTION

This invention relates to toner conveyors for electrostatographic processors and, more particularly, to methods and means for reclaiming the toner collected by the cleaning systems of such processors.

In a conventional electrostatographic printing process of the type described in Carlson's U.S. Pat. No. 2,297,691 on "Electrophotography", a uniformly charged imaging surface is selectively discharged in an image configuration to provide a latent electrostatic image which is then developed through the application of a finely divided coloring material, called "toner". As is known, that process has enjoyed outstanding commercial success, especially in plain paper xerographic copiers and duplicators. However, electrostatographic techniques are not limited to stand alone copiers and duplicator or even to xerography. For example, there are non-xerographic electrostatographic processors which have appropriately controlled stylii for selectively discharging the imaging surface to provide a latent image of the same general type as is generated by a xerographic processor. Furthermore, it has been found that xerographic and other electrostatographic processors have utility in a variety of arts, such as facsimile systems and computer printers, to name just a few.

Nevertheless, plain paper xerographic copiers and duplicators are generally representative of the problem to which this invention is addressed inasmuch as they rely on what is known as "transfer xerography". To automatically carry out that process, such a processor has a photosensitive imaging surface which is typically coated or otherwise deposited on a drum or belt which, in turn, is driven to sequentially advance the imaging surface through charging, exposure, development, transfer and cleaning stations.

The vehicle normally used to deliver the toner needed for development purposes is a multi-component developer comprising a mixture of toner particles and larger, so-called "carrier" particles. The materials for the toner and carrier (or, sometimes, carrier coating) components of the mixture are selected so that they are displaced from each other in the triboelectric series, whereby electrical charges of opposite polarities tend to be imparted to the toner and carrier particles when they rub together. Furthermore, in selecting the materials, consideration is given to their triboelectric ranking to the end that the polarity of the charge nominally imparted to the toner particles opposes the polarity of the latent images which are to be developed. Consequently, in operation, there are competing electrostatic forces acting on the toner particles. Specifically, there are forces which at least initially tend to attract them to the carrier particles. Additionally, the toner particles are subject to being electrostatically stripped from the carrier particles whenever they are brought into the immediate proximity of or actual contact with an imaging surface bearing a latent image.

Most of the toner deposited on the imaging surface during the development step is subsequently transferred to a suitable copy substrate (e.g., plain paper) as the imaging surface moves through the transfer station. Characteristically, however, there still is some residual toner which may be removed from the imaging surface before another copying cycle is initiated. To accomplish that, the cleaning station normally includes a blade, brush or some other means for dislodging the residual toner from the imaging surface and a sump for collecting that toner.

Others have already recognized that the practice of occassionally discarding the residual toner which collects in the sump of the cleaning system is a dirty and wasteful procedure. To overcome that problem, it has been suggested that a toner reclaim system be employed to transport the residual toner back into the development system where it can be re-used. That is a distinct improvement, but available toner reclaim systems are not altogether satisfactory.

SUMMARY OF THE INVENTION

Accordingly, an object of this invention is to provide relatively simple and reliable methods and means for transporting toner between spaced apart points along the imaging surface of an electrostatographic processor. A more detailed related object is to provide methods and means which take advantage of the movement of the imaging surface to transport the toner.

More particularly, an object of the present invention is to provide a magnetic toner reclaim system for electrostatographic processors.

Briefly, to carry out these and other objects of this invention, an electrostatographic processor having a development system containing a supply of ferromagnetic developer and a cleaning system with a sump for collecting residual toner removed from the imaging surface of the processor is equipped with a toner reclaim system comprising a plurality of magnets which are mounted at spaced apart intervals on one end or edge of the substrate for the imaging surface. In operation, the magnetic field provided by the magnets travel as the imaging surface is advanced through the successive processing stations of the processor, thereby magnetically conveying developer in a path which runs from the development system to the cleaning system via a first non-magnetic conduit and then from the cleaning system back to the development system via a second non-magnetic conduit. The developer passes through the sump of the cleaning system and triboelectrically interacts with the toner therein, whereby toner laden developer is returned to the development system.

BRIEF DESCRIPTION OF THE DRAWINGS

Still further objects and advantages of the invention will become apparent as the following detailed description is read in conjunction with the attached drawings, in which.

DETAILED DESCRIPTION OF THE ILLUSTRATED EMBODIMENT

While the invention is described in some detail hereinafter with reference to certain illustrated embodiments, it should be understood at the very outset that there is no intent to limit it to those embodiments. On the contrary, the aim is to cover all modifications, alternatives and equivalents falling within the spirit and scope of the invention as defined by the appended claims.

Figure 1:
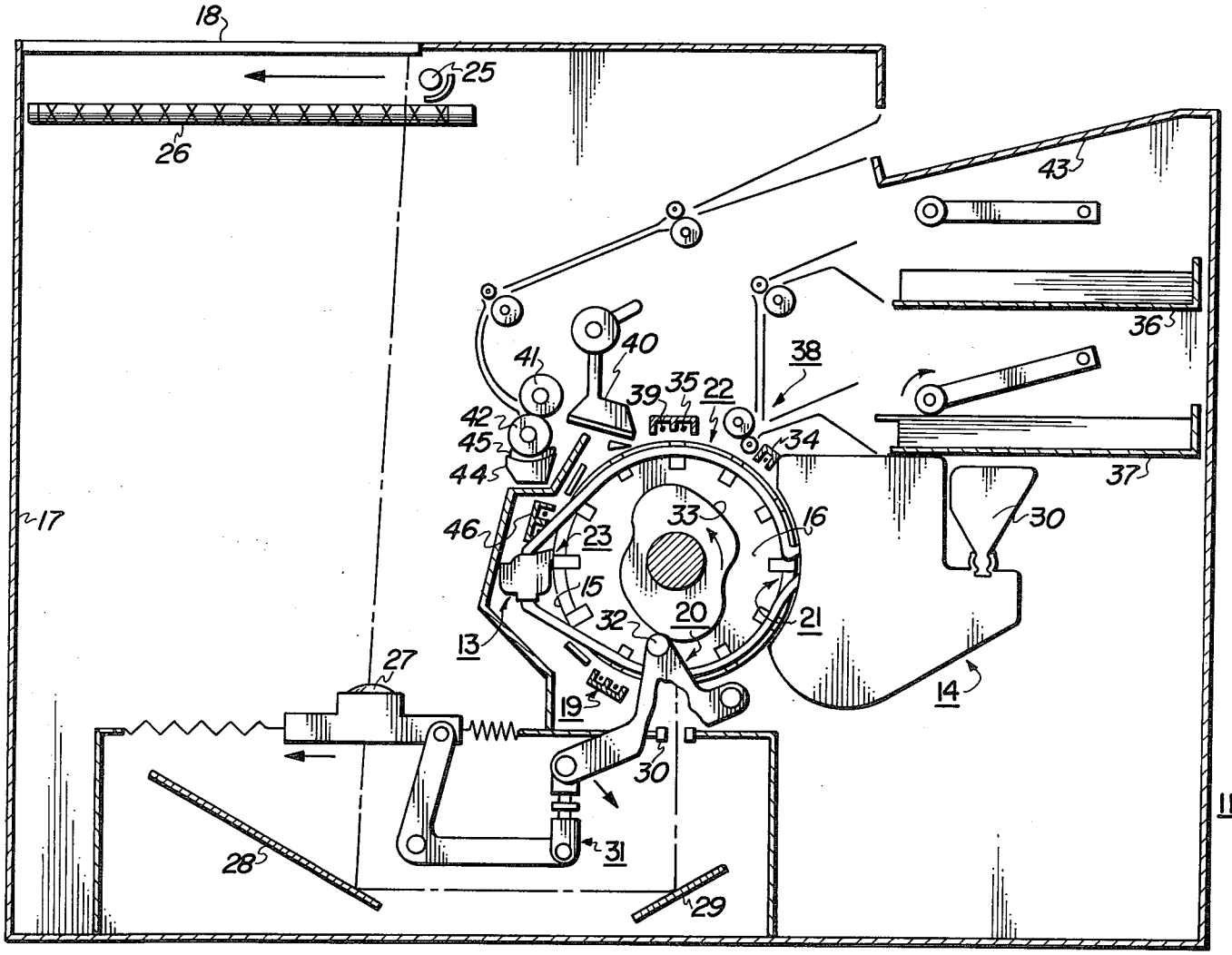
FIG. 1 is a simplified schematic diagram of an xerographic processor having a toner reclaim system constructed in accordance with the present invention.

Turning now to the drawings, and at this point especially to FIG. 1, it will be seen that there is an electrostatographic processor 11 having a toner reclaim system for returning toner collected by a cleaning system 13 to a development system 14. In this instance, the processor 11 is a xerographic copier having a photosensitive imaging surface 15 coated on the surface of a rotatable drum 16. Nevertheless, it will be appreciated that there are other suitable machine configurations, including one wherein a flexible photoconductor is supported by a belt-like substrate.

There is no reason to dwell on the processor 11. It is simply an examplary environment for this invention, and it closely resembles a commercially available "4000" copier of Xerox Corporation as modified to include the toner reclaim system 12 of this invention. Anyone interested in the specific details of that copier may, of course, inspect one of the commercially available units or refer to the published literature pertaining thereto, such as U.S. Pat. No. 3,724,019, which issued Apr. 3, 1973 in the name of Alan L. Shanly. Hence, a brief functional description will suffice.

Considering the processor 11 on that level, it will be observed that the drum 16 and its related components are enclosed within a housing 17 which has a transparent platen 18 for supporting a document or the like (i.e., the subject copy) image side down in position to be copied. The drum 16 is rotatably driven in the direction of the arrow so that the imaging surface 15 is sequentially advanced during each copying cycle through a charging station 19, an exposure station 20, a development zone 21, a transfer station 22, and a cleaning station 23.

At the outset of each copying cycle, the imaging surface 15 is uniformly charged by a corona generator 24 as it advances through the charging station 19 and then selectively discharged in response to light reflected from the subject copy as it advances through the exposure station 19. There is, therefore, a latent electrostatic image of the subject copy on the imaging surface 15 when it reaches the development zone 21.

To carry out the exposure step, this particular copier comprises a scanning lamp 25 which is driven from one side to the other of the platen 18 by a double helix auger drive 26 twice each copying cycle to illuminate successive lines or strips of the subject copy from below. The light reflected from the subject copy is intensity modulated in accordance with the image of interest and is focused on the imaging surface 15 by a movable lens 27, a pair of stationary mirrors 28 and 29, and an exposure slit 30. To maintain the focus, the movable lens 27 is laterally driven in timed synchronism with the scanning lamp 25. That is accomplished by means of a linkage 31 which has a follower 32 riding on a profiled camming surface 33, which, in turn, is mounted for rotation with the drum 16.

As described in more detail hereinbelow, the development system 14 uses a ferromagnetic developer to supply the toner needed to develop the latent images carried by the imaging surface 15. Fresh toner is supplied by a toner dispenser 30 from time-to-time in order to maintain the toner concentration of the developer at a suitably high level to develop the latent images as the imaging surface 15 moves through the development zone 21. Thereafter, the charge carried by the toner deposited on the imaging surface 15 is partially neutralized by a pre-transfer corona generator 34, thereby conditioning the toned or developed image for transfer to a copy sheet under the influence of a transfer corona generator 35 at the transfer station 22. The copy sheet is selectively fed from one of two supply trays 36 and 37 and is brought into contact with the imaging surface 15 by a sheet feeding and registration mechanism which is schematically shown at 38.

Continued rotation of the drum 16 advances the imaging surface 15 and the copy sheet beneath a detack corona generator 39 and then to a vacuum-type stripper 40. The detack corona generator 39 at least partially neutralizes the charge provided by the transfer corona generator 35, thereby assisting the stripper 40 in removing the copy sheet from the imaging surface 15.

The copy sheet is transported from the stripper 40 and into the nip between a pair of heated fuser rolls 41 and 42 which supply heat and pressure for fixing the toned image to the copy sheet. Consequently, the ultimate copy fed into the output tray 43 has a substantial degree of permanence. To minimize the tendency for toner to offset during the fusing process, there preferably is a reservoir 44 with a wick 45 for applying a release agent, such as silicone oil, to the lower fuser roll 42, which is the one that engages the image bearing side of the subject copy.

Figure 2:
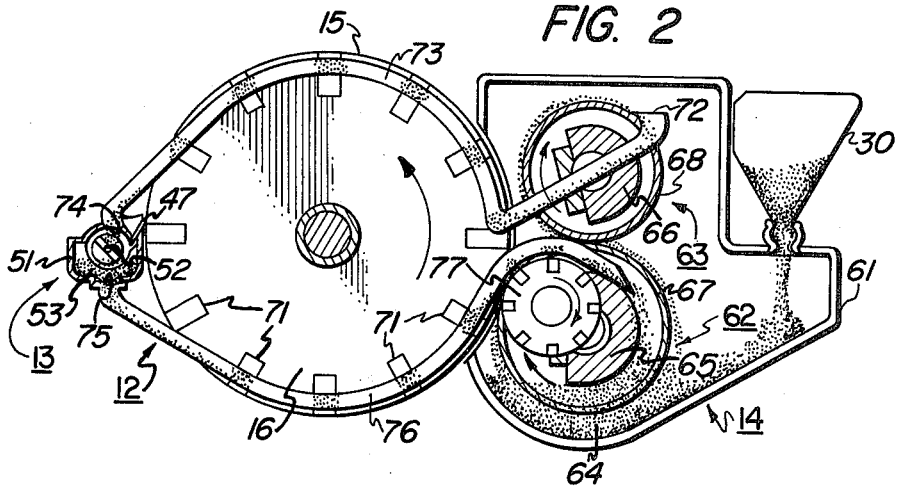
FIG. 2 is a simplified sectional view of the processor shown in FIG. 1.
Figure 3:
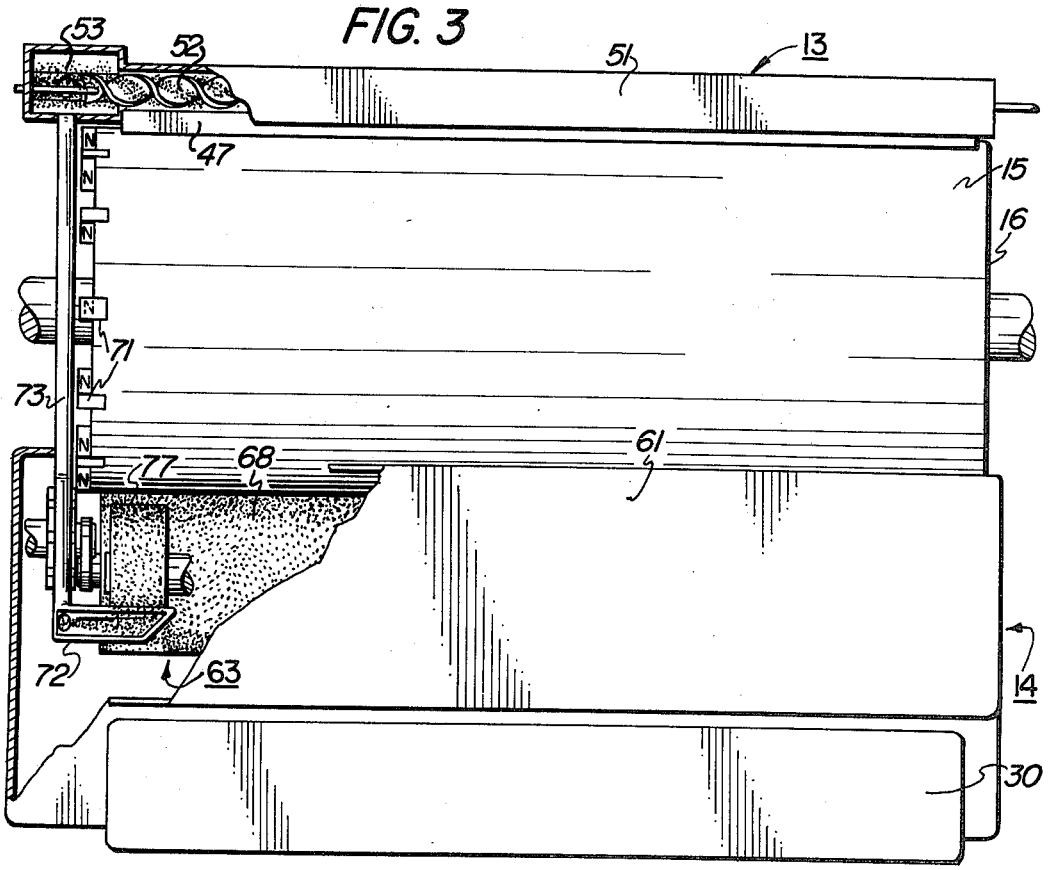
FIG. 3 is a plan view of the toner reclaim system wherein certain parts have been broken away in the interest of clarity.

While fusing is taking place, the imaging surface 15 advances into the cleaning station 23 where there is a pre-cleaning corona generator 46 which is followed by a cleaning blade 47 (FIGS. 2 and 3). The corona generator 46 at least partially neutralizes the charge tending to hold the residual toner in place, and the cleaning blade 47 then removes that toner from the imaging surface 15 in preparation for another copying cycle.

Referring to FIGS. 2 and 3, it will be seen that the cleaning system 13 and the development system 14 are illustrated in considerable detail. Nevertheless, it should be understood that these systems are merely convenient examples. Indeed, the cleaning system 13 is generally similar to the one described in Gerbasi's U.S. Pat. No. 3,752,576 on "Transport for Particulate Materials", and the development system 14 is patterned after the one described in Reichart, Jr.'s U.S. Pat. No. 3,707,947 on "Cross Channel Mixer". Hence, those patents are hereby incorporated by reference to expedite this disclosure.

Briefly, as shown, the cleaning system 13 has a housing 51 for supporting the cleaning blade 47 for collecting the residual toner removed from the imaging surface 15. The cleaning blade 47 extends across substantially the full width of the imaging surface 15 and its outer edge is maintained in pressure contact with that surface. Moreover, the cleaning blade 47 is held at an attack angle which is selected so that its outer edge provides a chisel-like cutting action to scrape or shave the residual toner from the imaging surface 15 and so that its upper surface guides that toner into the housing 51. Preferably, there is a rotatably driven auger 52 or the like journalled in the opposed end walls of the housing 51 to convey the toner into a sump 53 at one end of the housing.

The development system 14, on the other hand, is a magnetic brush unit having a housing 61 comprising an applicator roll 62 and a lifting roll 63 for circulating developer along a path which runs from a sump 64 in the lower reaches of the housing 61, upwardly through the development zone 21, and then back toward the sump 64. The developer is a triboelectrically charged mixture of toner particles and ferromagnetic carrier particles, and the rolls 62 and 63 extend across substantially the full width of the imaging surface 15. The function of the rolls 62 and 63 is to transport the developer upwardly from a pick-up point in the sump 64 to a release point near the top of the housing 61 under the influence of a magnetic field which is shaped to cause the developer to form bristle-like stacks or streamers which brush against the imaging surface 15 in the development zone 21 (i.e., the nip-like region between the imaging surface 15 and the applicator roll 62). To accomplish that, the rolls 62 and 63 typically include stationary permanent magnet assemblies 65 and 66 which are supported within non-magnetic, rotatably driven sleeves 67 and 68, respectively. Thus, the developer is magnetically entrained, first on the sleeve 67 and then on the sleeve 68, until it passes over the top of the lifting roll 63 where it is released to fall back toward the sump 64 under the influence of gravity.

In accordance with this invention, the toner reclaim system 12 circulates developer in a path which runs from the development system 14, through the sump 53 of the cleaning system 13, and then back into the development system 14. The developer blends with the residual toner as it passes through the cleaning system 53, thereby providing the developer with an opportunity to triboelectrically attract some of the residual toner. Preferably, therefore, provision is made for diverting part of the partially denuded developer emerging from the development zone 21 into the cleaning system 13. In addition, the developer displaces toner from the sump 53 and then mechanically pushes that toner back into the development system 14.

More particularly, in keeping with an important aspect of this invention, the toner reclaim system 12 relies on the motion of the drum 16 to circulate the developer used for toner reclaiming purposes. To that end, there are a plurality of permanent magnets 71 which are mounted on one end of the drum 16 at spaced apart angular intervals about its axis of rotation. The magnets 71 may either be discrete dipoles, such as separate bar magnets, or the individual dipoles of a multipole magnetic ring. At any rate, the poles of each of the magnets 71 are substantially radially aligned so that there are radially extending magnetic fields which travel in a generally circular closed loop as the imaging surface 15 is advanced through the successive processing station 19–23 of the copier 11 (FIG. 1).

To carry out this invention, as illustrated, a funnel 72 or the like is mounted behind the lifting roll 68 to divert part of the partially denuded developer emerging from the development zone 21 into one end of a non-magnetic conduit 73 which then guides that developer into an input port 74 at the top of the cleaning system sump 53. The developer blends with or pushes the residual toner as it passes through the sump 53 so that it tends to displace toner and to have its toner concentration increased as previously mentioned. The developer and displaced toner then flows out of a discharge port 75 at the bottom of the sump 53 and enters another non-magnetic conduit 76 which guides it back into the development system sump 64. As will be seen, the conduits 73 and 76 extend along generally arcuate paths adjacent the magnets 71 on the upper and lower parts, respectively, of the drum 16, whereby the developer flowing to and from the cleaning system sump 53 is magnetically conveyed under the influence of the magnetic field supplied by one or more of the magnets 71. Suitably, the conduit 76 extends downwardly and forwardly through the development system housing 61 so that the developer flowing toward the cleaning system sump 53 is gravity fed until it comes under the influence of the fields supplied by the magnets 71. Additionally, to maintain a positive flow of developer, there desirably is a rotatably driven magnetic transport roll 77 mounted in the development system housing 61 adjacent the conduit 76 to magnetically propel the returning developer into the sump 64.

Figure 4:
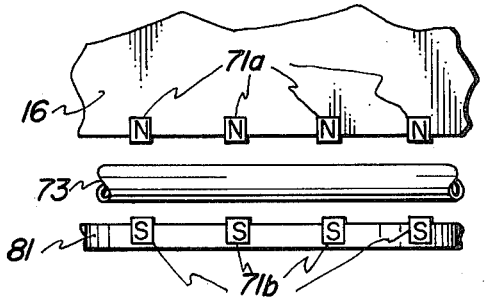
FIG. 4 is an enlarged, fragmentary plan view of a magnetic conveyor for the toner reclaim system.
Figure 6:
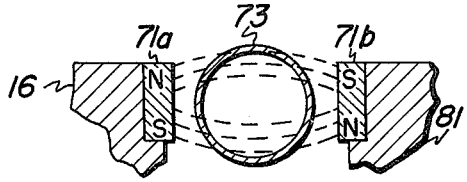
FIG. 6 is an enlarged, fragmentary sectional view of the magnetic conveyor shown in FIG. 4.
Figure 7:
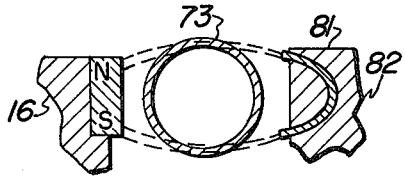
FIG. 7 is a fragmentary sectional view of another magnetic conveyor for the toner reclaim system.
Figure 5:
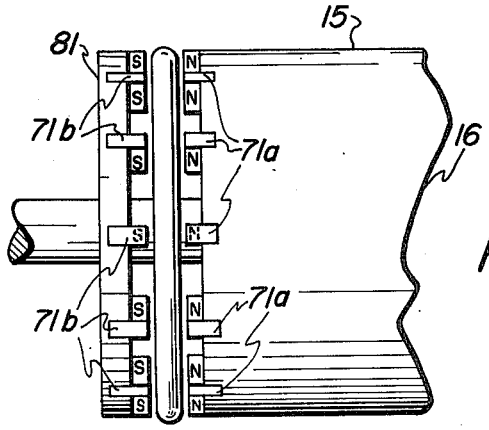
FIG. 5 is a fragmentary plan view of the processor as modified to accomodate the magnetic conveyor shown in FIG. 4.

Turning finally to FIGS. 4–7, it will be seen that various techniques may be employed to improve the efficiency of the magnetic conveyor for the toner reclaim system 12. For example, the conduits 73 and 76 may be supported between spaced apart, oppositely poled sets of magnets 71*a* and 71*b* to increase the flux density of the magnetic fields acting on the developer 76 (FIGS. 4–6). As shown, the magnets 71*a* are mounted at spaced apart intervals on one end of the drum 16, much in the same manner as the magnets 71 of the basic embodiment. The other magnets 71*b* are similarly spaced to pair off with respective ones of the magnets 71*a*, but are carried on a separate ring or plate 81 which is mounted for rotation with the drum 16. Alternatively, ferromagnetic pole pieces 82 (FIG. 7) may be used to provide relatively low reluctance flux paths for shaping the fields provided by the magnets 71. In that event, the poles pieces 82 are mounted on the plate 81 in place of the magnets 71*b*.

CONCLUSION

In view of the foregoing, it will now be understood that the present invention provides a relatively simple, reliable and compact toner reclaim system for electrostatographic processors.

What is claimed is:

1. In an electrostatographic processor having an imaging surface;

a movable substrate for sequentially and cyclically advancing said imaging surface through a plurality of spaced apart processing stations, including a development zone and a cleaning station;

a development system including a sump for storing a supply of developer containing triboelectrically charged toner and ferromagnetic carrier particles, and means for circulating said developer into and through said development zone to provide toner for developing latent electrostatic images carried by said imaging surface; and a cleaning system including means at said cleaning station to remove residual toner from said imaging surface, and a sump for collecting the residual toner in bulk form;

the improvement comprising a toner reclaim system including means for magnetically conveying developer from said development system through the sump of said cleaning system, and then back into said development system, said means for conveying the developer comprising a first non-magnetic conduit for guiding developer from said development system to the sump of said cleaning system, a second non-magnetic conduit for guiding developer from the sump of said cleaning system to said development system, and a plurality of magnets mounted for movement with said imaging surface to supply magnetic fields for entraining and conveying developer within said first and second conduits.

2. The improvement of claim 1 wherein said magnets are mounted at spaced apart intervals on said substrate.

3. The improvement of claim 2 further including separate pole pieces for said magnets, and means for supporting said poles pieces for movement with said substrate in spaced apart alignment with respective ones of said magnets; and wherein said first and second conduits are disposed between said magnets and said pole pieces.

4. The improvement of claim 1 wherein said plurality of magnets includes first and second sets of oppositely poled magnets, and means for supporting said first and second sets of magnets for movement with said substrate on opposite sides of said conduits.

5. The improvement of claim 1 wherein each of the magnets of said first set is maintained in alignment with a respective one of the magnets of said second set.

6. The improvement of claim 1 wherein the developer circulated by said toner reclaim system is diverted out of said development system at a point remote from said sump and downstream of said development zone, whereby the developer in said reclaim system initially tends to have a relatively low toner concentration.

7. The improvement of claim 6 wherein the developer circulated by said toner reclaim system is returned to the sump of said development system.

8. The improvement of claim 7 wherein said developer includes a ferromagnetic carrier component; and said toner reclaim system comprises a pair of non-magnetic conduits extending between said development system and the sump of said cleaning system, and means for magnetically conveying developer from said development system to the sump of said cleaning system via one of said conduits and from the sump of said cleaning system back into said development system via the other of said conduits.

9. The improvement of claim 8 wherein said development system has a housing; and said toner reclaim system comprises a rotatably driven magnetic transport roll mounted in said housing for magnetically propelling developer out of said other conduit and into the sump of said development system.

10. The improvement of claim 9 wherein said processor is a xerographic unit having a photoconductive imaging surface.

11. The improvement of claim 8 wherein said means for magnetically conveying developer via said conduits comprises at least one set of magnets mounted at spaced apart intervals on said substrate adjacent one side of said conduits.

12. The improvement of claim 11 wherein said means for magnetically conveying developer via said conduits further includes a member mounted for movement with said substrate on the opposite side of said conduits, and a plurality of pole pieces mounted at spaced apart intevals on said member in alignment with respective ones of said magnets.

13. The improvement of claim 11 wherein said means for magnetically conveying developer via said conduits further includes another set of magnets, and a member mounted for movement with said substrate on the opposite side of said conduits for supporting each of the magnets of said other set in alignment with a respective one of the magnets of said one set.

14. An arrangement for circulating developer including a ferromagnetic carrier from a first process station to a second process station in an electrostatographic machine, said stations being arranged about a rotatable cylindrical imaging surface comprising arcuate non-magnetic tube means forming a first path from said first station to said second station, and a second path from said second station back to said first station, said tube means extending adjacent said surface, and magnetic means mounted for rotation with said surface for transporting said developer along said tube means in the direction of rotation of said surface from said first station to said second station and back to said first station.

15. The combination recited in claim 3 wherein said first station is a development station and said second station is a cleaning station.

* * * * *